US011645973B1

(12) United States Patent
Li et al.

(10) Patent No.: US 11,645,973 B1
(45) Date of Patent: May 9, 2023

(54) PROGRAMMABLE ELECTRODE VOLTAGE SWING REDUCTION APPARATUS AND METHOD

(71) Applicant: SCT LTD., Grand Cayman (KY)

(72) Inventors: Eric Li, Milpitas, CA (US); Yi Zhang, Milpitas, CA (US); Shang-Kuan Tang, Milpitas, CA (US); Shean-Yih Chiou, Milpitas, CA (US)

(73) Assignee: SCT LTD., Grand Cayman (KY)

( * ) Notice: Subject to any disclaimer, the term of this patent is extended or adjusted under 35 U.S.C. 154(b) by 0 days.

(21) Appl. No.: 17/652,855

(22) Filed: Feb. 28, 2022

(51) Int. Cl.
*G09G 3/32* (2016.01)
*H05B 45/325* (2020.01)

(52) U.S. Cl.
CPC ..... *G09G 3/32* (2013.01); *H05B 45/325* (2020.01); *G09G 2300/0452* (2013.01); *G09G 2310/0248* (2013.01); *G09G 2320/0252* (2013.01); *G09G 2320/0257* (2013.01); *G09G 2330/021* (2013.01)

(58) Field of Classification Search
CPC ... G09G 3/32–3291; G09G 2300/0421; G09G 2300/0426; G09G 2300/0452; G09G 2300/06; G09G 2310/0243–0251; G09G 2310/0289; G09G 2310/06; G09G 2310/061; G09G 2310/063; G09G 2310/08; G09G 2320/0209; G09G 2320/0214; G09G 2320/0223; G09G 2320/0252; G09G 2320/0257; G09G 2320/0264; G09G 2330/021; G09G 2330/025
See application file for complete search history.

(56) References Cited

U.S. PATENT DOCUMENTS

2005/0259054 A1* 11/2005 Wu ..... G09G 3/3216 345/82
2008/0150845 A1* 6/2008 Ishii ..... G09G 3/3208 345/77
2012/0327129 A1* 12/2012 Li ..... G09G 3/3413 345/83
2015/0302797 A1* 10/2015 Lu ..... G09G 3/32 345/83
2016/0351121 A1* 12/2016 Kim ..... G09G 3/3233

* cited by examiner

*Primary Examiner* — Nathan Danielsen
(74) *Attorney, Agent, or Firm* — Novick, Kim & Lee, PLLC; Allen Xue

(57) ABSTRACT

An LED display panel contains an LED array having a plurality of LED pixels, a plurality of scan switches, and a plurality of LED columns. The anode of each LED pixel in each LED column is connected to a common anode node and the common anode node is connected to an output of a current source, while the cathode of each LED pixel in each LED column is switchably connected to a current sink via one of the plurality of scan switches. The common anode node is connected to a first input of a comparator circuit and is switchably connected to an anode voltage source. The second input of the comparator circuit is connected to a reference voltage source and an output of the comparator circuit signally controls a switch member that switchably connects the common anode node to the current sink.

20 Claims, 15 Drawing Sheets

PROGRAMMABLE ELECTRODE VOLTAGE SWING REDUCTION APPARATUS AND METHOD

THE TECHNICAL FIELD

The present disclosure relates generally to LED display systems, which comprise an LED array and a voltage control circuit. More particularly, this disclosure relates to methods and apparatus that reduce LED voltage swings and increase energy efficiency.

BACKGROUND

Devices and applications involving LEDs (i.e., light emitting diodes) are gaining popularity, ranging from light sources for general illumination, signs, and signals, to display panels, televisions, etc. A variety of control circuits are used in controlling and supplying power to the LEDs.

An LED panel contains an array of LEDs or a plurality of LED arrays that are connected together as well as control circuits therefor. LED panels usually employ arrays of LEDs of a single color or different colors. When individual LEDs are used in certain display applications, each LED usually corresponds to a display pixel. An RGB LED unit (or an RGB LED pixel) refers to a cluster of three LEDs, namely, a red LED, a green LED, and a blue LED. When RGB LED units are used in certain display applications, each RGB LED unit corresponds to a display pixel. Surface mounted RGB LED units usually have four pins, one pin for each of the red, green, and blue LEDs and another pin for either a common anode or a common cathode that are shared by the red, green, and blue LEDs.

Traditionally LED arrays are often arranged in a common anode scan configuration, in which the anode of the LEDs are operatively connected to a power source via a switch element while the cathode of the LEDs are tied to a current sink. In such a configuration, an NMOS driver is often used as the current sink. An NMOS is preferable over a PMOS because NMOS has a larger current capacity and a lower ON resistance (RDS(on)) for a given design geometry.

The common cathode configuration is also used, in which the LEDs in a row are connected to a scan line. During operation, the voltage of the scan line is pulled down from an elevated voltage to turn on the array of LEDs one line at a time. The scan line then may be charged back to turn off this particular scan line. Such charging and discharging of the scan lines causes voltage swings and creates noises.

Anode side constant current source charges LED anode to a certain voltage level to turn on LED, then current source is turned off and the anode voltage is pulled down to the ground level. This anode side power swing also wastes electric energy and generates noises.

It is desirable to reduce voltage swings and noises in LED drivers and/or boards, as it reduces power consumption of the drivers/boards to meet green standard, and to increase the reliability of the drivers and/or boards. Further, reducing voltage swings and noises of LED drivers/boards is even more important for smaller, high resolution LED displays, which requires its drivers to drive more LED pixels so that there are more capacitance loadings and un-loadings in both anode and cathode in the LED panel. Consequently, any significant voltage swings cause more instability and more power consumption in the LED panel. Therefore, it is desirable to reduce voltage swing and noises caused by the swing, to reduce power consumption in transient operations in LED panels.

SUMMARY OF DISCLOSURE

The current disclosure provides programmable electrode voltage swing reduction devices and methods that reduce the circuit noise and power consumption in LED display panels.

According to one of the embodiments in this disclosure, a light emission diode (LED) display panel contains an LED array having a plurality of LED pixels, a plurality of scan switches, and a plurality of LED columns. Each LED pixel is connected to one of the plurality of LED columns. Further, the anode of each LED pixel in each LED column is connected to a common anode node and the common anode node is connected to an output of a current source while the cathode of each LED pixel in each LED column is switchably connected to a current sink via one of the plurality of scan switches. In addition, the common anode node is connected to a first input of the comparator circuit and is switchably connected to an anode voltage source. The second input of the comparator circuit is connected to a reference voltage source while an output of the comparator circuit signally controls a switch member that connects the common anode node to the current sink or disconnects the common anode node from the current sink.

According to some embodiments, a cathode of each LED pixel in each LED column is switchably connected to a common cathode node, and the common cathode node is switchably connected to a cathode voltage source.

According to further embodiments, all LEDs in the LED array can be single color LEDs or RGB LED units. The each RGB LED unit, an anode of the red LED is connected to a first current source, an anode of the green LED is connected to a second current source, and an anode of blue LED is connected to a third current source. Alternatively, an anode of the red LED is connected to one current source while an anode of the green LED and an anode of blue LED are connected to a different current source.

According to still another embodiment, the common anode node is switchably connected to ground via a current sinking source.

The disclosure also provides a method for operating the LED array, which includes the steps of charging anodes of the plurality of LEDs to an anode voltage by connecting the anodes of the plurality of LEDs to the anode voltage source via the common anode node; connecting a cathode of a first LED in the plurality of LEDs to the current sink by closing a first scan switch; turning on the first LED by passing a first driving current through the first LED; setting a reference voltage of the reference voltage source at a value lower than the anode voltage; and pulling down a voltage of the common anode node to the reference voltage, wherein the comparator causes the common anode node to be connected to the current sink when the voltage in the common anode node is higher than the reference voltage.

According to some embodiments, the method also includes pulling up the voltage of the common anode node by connecting the common anode node to the anode voltage source; and connecting a cathode of a second LED in the plurality of LEDs to the current sink by closing a second scan switch; and turning on the second LED by passing a second driving current through the second LED.

In still another method for reducing voltage swing of a plurality of LED pixels in an LED array, the following steps are implemented: connecting anodes of each LED pixel to a common anode node; connecting the common anode node to an output of a current source and a first input of a comparator; connecting a reference voltage source to a second input of a comparator; sequentially lighting the plurality of LED pixels by sequentially connecting a cathode of one of the plurality of LED pixels being lit to a current sink and disconnecting cathodes of a remainder of the plurality of LED pixels from the current sink; and enabling the comparator to compare a reference voltage of the reference voltage source with a voltage of the common anode node after one LED pixel among the plurality of LED pixels is turned off and before another LED pixel among the plurality of LED pixels is turned on so that the voltage of the common anode node is maintained at about the reference voltage.

The method may further include steps of disabling the comparator; and connecting the common anode node to an anode voltage source so that the voltage of the common anode node is about a voltage of the anode voltage source.

According to some of the methods, when the voltage of the common anode node is higher than the reference voltage, the comparator causes the common anode node to be connected to a current sink. Other methods include the step of connecting the cathodes of the remainder of the plurality of LED pixels to a cathode voltage source.

In some embodiments the reference voltage is adjustable and is set at 0.1-0.8 V lower than the voltage of the anode voltage source, for example at 0.2-0.4 V lower than the voltage of the anode voltage source. The cathode voltage is also adjustable and is set at 0.2-0.8 V, for example, 0.3-0.5 V.

DESCRIPTIONS OF DRAWINGS

The teachings of the present disclosure can be readily understood by considering the following detailed description in conjunction with the accompanying drawings.

DETAILED DESCRIPTION OF THE EMBODIMENT

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

The Figures (FIG.) and the following description relate to the embodiments of the present disclosure by way of illustration only. It should be noted that from the following discussion, alternative embodiments of the structures and methods disclosed herein will be readily recognized as viable alternatives that may be employed without departing from the principles of the claimed inventions.

Reference will now be made in detail to several embodiments of the present disclosure(s), examples of which are illustrated in the accompanying figures. It is noted that wherever practicable similar or like reference numbers may be used in the figures and may indicate similar or like functionality. The figures depict embodiments of the present disclosure for purposes of illustration only. One skilled in the art will readily recognize from the following description that alternative embodiments of the structures and methods illustrated herein may be employed without departing from the principles of the disclosure described herein. Numerous specific details are set forth in the following description in order to provide a thorough understanding of the invention. These details are provided for the purpose of example, and the invention may be practiced according to the claims without some or all of these specific details. For the purpose of clarity, technical material that is known in the technical fields related to the invention has not been described in detail so that the invention is not unnecessarily obscured.

Figure 1A:
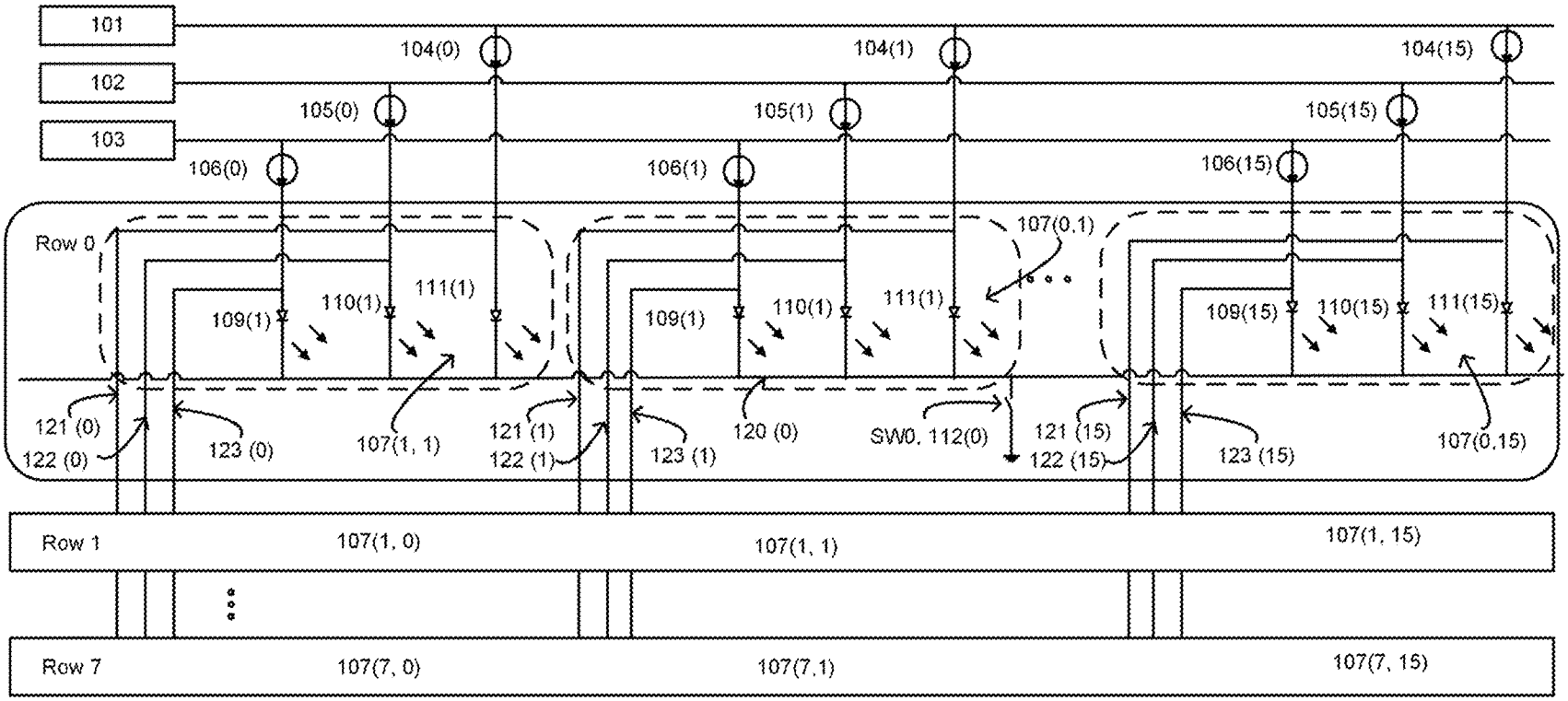
FIG. 1A is a diagram illustrating an embodiment of an LED array according to the current disclosure.

FIG. 1A is a diagram showing an LED array according to one embodiment of the current disclosure, i.e., a common cathode configuration. The LED array in the LED panel system comprises an 8×16 matrix of RGB LED units 107, power sources 101, 102, and 103, and a plurality of constant current sources 104, 105, and 106. Letter "m" represents a row number in the matrix, which ranges from 0 to 7. Letter "n" represents the column number in the matrix, which ranges from 0 to 15. The letters placed in parenthesis following a reference numeral indicate the location of the component in the LED array. For example, 107(2, 4) is an RBG LED unit located at the intersection of row 2 and column 4.

The RGB LED unit 107 comprises a red LED 109, a green LED 110, and a blue LED 111 packaged into one integrated component. The RGB LED unit 107 has four output pins, one of which is a common cathode pin (i.e., the cathode shared among the red, green, and blue LEDs), the other three are the anodes of red, green, and blue LEDs. The common cathode pin is connected to a common cathode node 120. In the embodiment shown in FIG. 1A, a common cathode node 120 connects the cathodes of the RGB LED units in a same row. The numeral 120(*m*) indicates a common cathode node for the m-th row. The common cathode node 120(0) is switchably grounded via scan switch SW0.

The anodes of red LEDs in a same column of the matrix are connected to a common anode node 121 ("the red LED common anode node"), which is connected to constant current source 104, where n is the column number and ranges from 0-15. The current source 104 is in turn powered by the power source 101($P_{Red}$), having a voltage $V_{DD_Red}$. The anodes of green LEDs in the same column of the array are connected to a common anode node 122 ("the green LED common anode node"), which is connected to constant current source 105. The current source 105 is connected to the power source 102 ($P_{Green}$), having a voltage $V_{DD_Green}$. Likewise, the anodes of blue LEDs in the same column of the array are connected to a common anode node 123 ($P_{Blue}$), which is connected to the constant current source 106. The current source 106 is further connected to the power source 103, having a voltage $V_{DD_Blue}$. Therefore, current sources 104(*n*), 105(*n*), and 106(*n*) are respectively common current sources for red, green, and blue LEDs in the n-th column. In this disclosure, a "channel" or an "LED channel" corresponds to one common anode node.

The columns and rows in the LED array may be arranged in straight or non-straight lines. LEDs in a same row are connected to a common node, which could be either a common anode node or a common cathode node. Correspondingly, LEDs in a same column are connected to another common node. When LEDs in a same row are connected to a common anode node, the LEDs in a same column are connected to a common cathode node, and vice versa.

In the configuration depicted in FIG. 1A, the voltages for power sources 101, 102, and 103 can be individually set in accordance with the different forward voltages of the red, green, and blue LEDs—$V_{F\text{-}Red}$, $V_{F\text{-}Green}$, and $V_{F\text{-}Blue}$, respectively. The $V_{DD}$ of a particular path can be expressed in the following general formula:

$$V_{DD}=N*V_F+V_{DSP}+V_{DSN}$$

wherein N stands for the number of LEDs connected to a same common anode node, $V_{DSP}$ stands for the voltage between the drain and source of a PMOS that is in the same channel as the common anode node, and $V_{DSN}$ stands for the voltage between the drain and source of an NMOS that is in the same channel as the common cathode node. In this case, VF represents the mathematical average of the forward voltage of all LEDs that are connected to the common anode node.

When $V_{DSP}$ and $V_{DSN}$ for various red, green, or blue LED channels (i.e., a channel that comprises the red common anode node, or the green common anode node, or the blue common anode node) are of a same or similar value, and each LED channel has N number of LEDs, and the LEDs in the same channel have the same forward voltage, the following equations are true:

$$V_{DD_Blue}-V_{DD_Red}=N(V_{F_Blue}-V_{F\text{-}Red})$$

$$V_{DD_Green}-V_{DD_Red}=N(V_{F_Green}-V_{F\text{-}Red})$$

For LEDs used in small pixel pitch applications, e.g., high resolution displays, $V_{F\text{-}Red}$ ranges, for example, from 1.6 volts to 3.0 volts, or from 1.8 volts to 2.4 volts, while $V_{F\text{-}Green}$ and $V_{F\text{-}Blue}$ range, for example, from 2.6 volts to 3.6 volts, or from 2.6 volts to 3.8 volts. The differences among the forward voltages allow one to chose $V_{DD}$ based on the forward voltage of LEDs in a particular LED path. In contrast, in configurations where one power source supplies the whole array of LEDs, all the anodes of the LEDs are electrically connected to the same power source (i.e., a common anode configuration), $V_{DD}$ is the same for all LEDs paths. The voltage overhead on the red LED paths is wasted, usually as heat generated on a bias resistor.

The common cathode topology as shown in FIG. 1A, by using different power sources for red, green, and blue LEDs, allows selecting a power supply voltage that closely matches the forward voltage of LEDs of a particular color. Consequently, the red LED may use a power supply voltage lower than that of the green or the blue LED, reducing the power consumption in the red LED path.

Figure 1B:
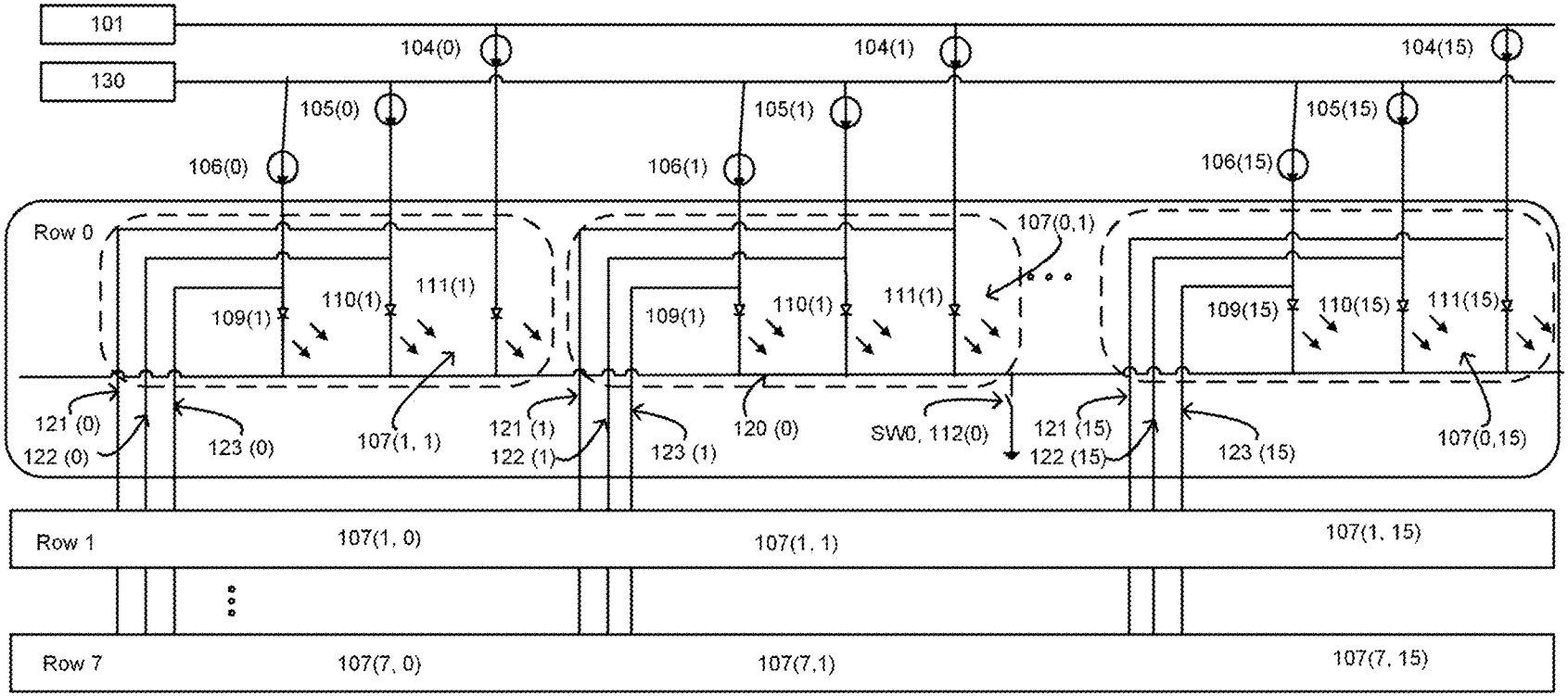
FIG. 1B is a diagram illustrating another embodiment of an LED array according to the current disclosure.

FIG. 1B shows another embodiment according to the current disclosure. The same numerals in FIG. 1A and FIG. 1B refer to the same components or devices. In the embodiment of FIG. 1B, the power source 130 ($P_{GB}$) supplies voltage $V_{DD\text{-}GB}$ for both the green LED common anode nodes and the blue LED common anode nodes. In this configuration, only two power sources are required to power the RGB LED units, one for powering the red LEDs, and the other for powering both the green and the blue LEDs.

Figure 1C:
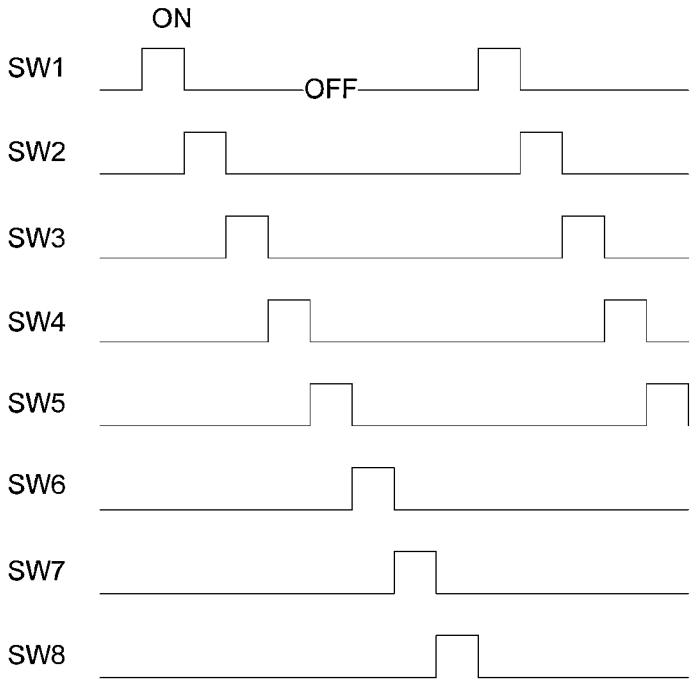
FIG. 1C is a timing diagram for embodiments shown in FIGS. 1A and 1B.

In the embodiments of FIG. 1A and FIG. 1B, each common cathode node 120 is connected to a switch. These switches are usually turned ON or OFF according to certain sequences. FIG. 1C is the timing diagram for $SW_0$, $SW_1$, $SW_2$, . . . $SW_7$ in a scan mode of operation, which illustrates such a sequence. According to FIG. 1C, switch $SW_0$ is turned on for a period of time Δ_on, then at the end of Δ_on period, $SW_0$ is turned off and $SW_1$ is turned on, then for the same period of time Δ_on, $SW_1$ remains on during that period, then at the second end of Δ_on period, $SW_1$ is turned off and $SW_2$ is turned on for the same period of time Δ_on, $SW_2$ remains on during that period, then at the third end of Δ_on period, $SW_2$ is turned off, etc., until at the end of the seventh end of Δ_on period, $SW_6$ is turned off and $SW_7$ is turned on for the same period of time Δ_on. Therefore, only one among $SW_0$ to $SW_7$ are on at any given time and each of the $SW_0$ to $SW_7$ have the same duty cycle duration of Δ_on.

In other switching sequences, there is a time interval between when a preceding switch (e.g., $SW_0$) is turned off and when a subsequent switch (e.g., $SW_1$) is turned on. This time interval may occur simultaneously as shown in FIG. 1C. However, the duration of the interval varies from a few nano-seconds to thousands of nano-seconds, for example, several hundred nano-seconds. As a result, among the switches that are tied to the same current source through LEDs, no more than one switch is on at any given time. The constant current source supplies only one row of RGB LED units at any given time. Therefore, both the capacity and the cost of the constant current source can be significantly reduced. If the scan frequency is high enough, human eyes are not able to discern the ON/OFF states and the visual quality is not affected.

A node that a switch turns on or off is often called a scan line and the switches are often called scan switches. In the embodiment of FIG. 1A and FIG. 1B, the common cathode nodes correspond to scan lines.

Many variations of the above described embodiments are available. For example, a pixel of the LED panel may comprise one RGB LED unit, or several LEDs of the same or different colors. The LEDs in different pixels may also have the same or different colors.

The array of LEDs can be arranged into a variety of geometric shapes, either two-dimensional such as rectangular or circular, or three-dimensional such as cylindrical or spherical. In LED display panels, when LEDs are used as pixels, the distances between two adjacent pixels can be same or different.

The LED array disclosed herein can be readily scaled up. The LED array can have many rows and columns, e.g., 256 rows by 256 columns. Such LED arrays can be used as an LED display panel by themselves or used as a sub-module in a larger LED display panel. For example, an LED display panel can be composed of 120×135 sub-modules of the 16×8 LED arrays, resulting in a resolution of 1920×1080.

Figure 2:
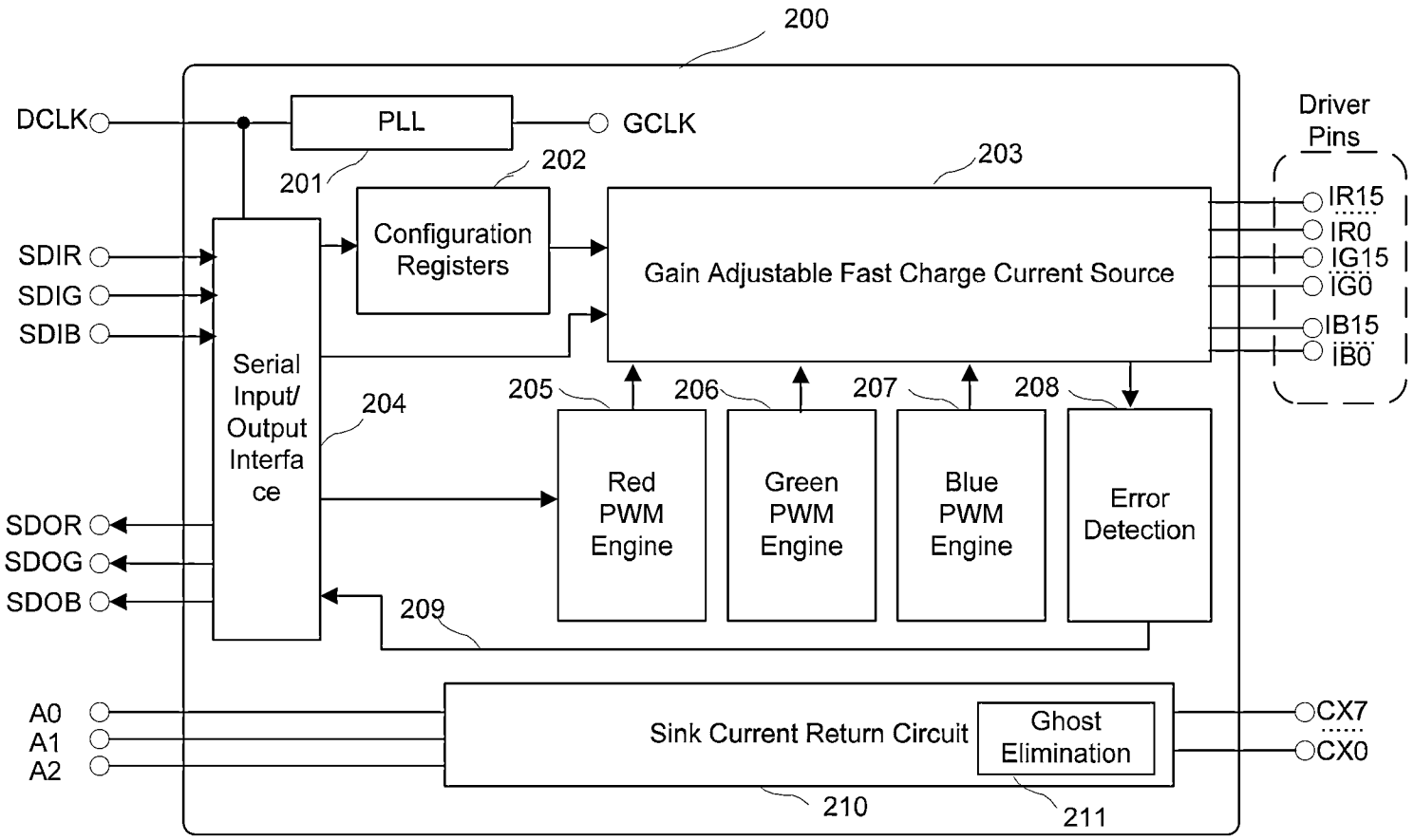
FIG. 2 is a diagram schematically illustrating an exemplary driver circuit for an LED array.

FIG. 2 is a schematic diagram an LED driver circuit of the present disclosure. Each functional block in FIG. 2 represents one or more circuits and accomplishes one or more functions as disclosed in the following sections. The circuits can either be discrete components on a PCB or be integrated on a chip. Individual circuits in the driver IC can be constructed by one skilled in the art according to known methods using known parts, or in accordance with methods and devices provided in this disclosure. For the purpose of illustration, the LED driver circuit of FIG. 2 drives a 16×8 array of RGB LED units, i.e., sixteen LED channels and eight scan lines. Such a driver circuit may drive LED arrays of different sizes.

According to one embodiment of the current disclosure, the driver IC comprises the functional blocks encircled in box 200. As shown in FIG. 2, such a functional block comprises an on-chip phase locked loop (PLL) 201, a serial input/output interface 204, a configuration register block 202, a gain adjustable fast charge current source circuit 203, an error detection circuit 208, three pulse width modulation (PWM) engines (red PWM engine 205, green PWM engine 206 and blue PWM engine 207), a return sink current circuit 210, and a ghost elimination circuit 211.

The on-chip PLL block 201 generates an accurate and high frequency global clock signal GCLK. It may do so by having an internal GCLK (global clock buffer) or by receiving external GCLK signals sent by a user. The global clock signal serves as the clock input for the PWM engines 205, 206 and 207 within the driver IC. The DCLK (dot clock) serves as an input reference clock for the PLL. Integrating the PLL into the driver IC reduces the PCB layout requirement for high speed lines otherwise required when the PLL is on the PCB, physically separated from the LED driver IC.

The serial I/O interface block 204 is used to load driver IC settings into the configuration register block 202, to load gray scale values to the PWM engines (205, 206 and 207), and to load DOT correction settings into the memory within the gain adjustable fast charge current source circuit 203. It is also the interface to read out configuration settings from the configuration registers 202 and the error status from the error detection IC.

The configuration register block 202 stores the various settings for the LED driver IC. These settings are defined as a 16-bit register for each color channel, e.g., red, blue, and green.

The gain adjustable fast charge current source circuit 203 is implemented to provide a stable current source output based on the PWM signal from the PWM engines 205, 206, and 207. The current source circuit 203 is designed to improve the current respond time. The output current from the current source circuit 203 is adjusted based on the driver setting. There are two levels of gain adjustments: one is a global adjustment per color, the other is a DOT correction adjustment per output LED. The fast charge circuit 203 is further illustrated in FIG. 3 and discussed below.

The error detection circuit 208 monitors the 48-channel output from the current source block 203 to detect short circuit and report the status back to the serial I/O interface block 204. During the operation, if there is a short within an LED, the voltage drop across the LED will become minimal. The error detection circuit will detect that the voltage drop is lower than the short threshold and flag a short LED. In one embodiment, the configuration register may be set to switch off a channel's output when a short within an LED is detected. According to another embodiment, the error detection circuit simply reports the error through status line 209.

The PWM engines 205, 206, 207 are responsible for generating PWM pulses for each of the 16 channels. For each channel, it loads eight 16-bits gray scale values, one per each of the eight scan lines. The PWM engines output PWM pulses with the width of the pulse matching the gray scale set to the channel. For a single channel, the PWM engine circuit output loops through all the eight scan lines and provides gray scale output level ranging from 0 to 65535 (i.e., $2^{16}$). The operation of a PWM engine is further explained in FIG. 4.

The driver IC further comprises a sink current return circuit 210. The sink current return circuit 210 comprises a 3-8 decoder. It takes scan line address signals A0, A1, and A2 and translates them into a single scan line switch input signal to control scan switches and decides CX0 to CX7 potentials. For example, when the driver IC of FIG. 2 is connected to the LED arrays of FIG. 1A or FIG. 1B, CX0 to CX7 match the scan lines and are controlled by scan switches SW0 to SW7, which are integrated on the driver IC.

When SW1 is on, and thus CX1 is connected to ground, all current from sixteen channels of LEDs on scan line 1 are returned through CX1. When CX1 is switched off, the scan line selection is effectively turned off for scan line 1, shutting off all LEDs on scan line 1.

The embodiment of driver IC according to FIG. 2 may comprise a ghost image cancellation logic 211 in the sink current return circuit 210. Ghost image occurs due to the residual capacitance across the switches when the switches are switched off. After CX switches a scan switch off, the effective capacitance across the switch may cause the LED to be on for a short period of time at the moment when the next scan line and the succeeding PWM signal turn ON. The ghost image cancellation logic is implemented to pull up the voltage on the scan switch and to cancel the ghost effect.

Figure 3:
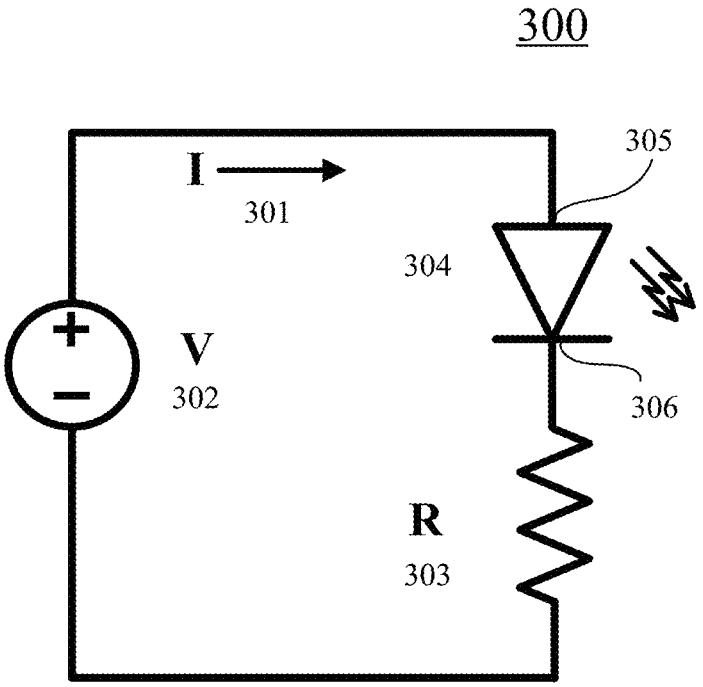
Prior Art FIG. 3
FIG. 3 is a diagram schematically illustrating a control circuit for an LED.

FIG. 3 illustrates an exemplary driver circuit for a low-power indicator LED. An LED circuit or LED driver 300 is an electrical circuit used to power a light-emitting diode (LED) 306. The LED 306's positive end 305 is called as anode, while its negative end 306 is called as cathode. The power supply 302 provides a current 301, which flows into the anode 305 of the LED. The cathode 306 of the LED is connected to a bias resistor 303. The voltage drop 302 across an LED is approximately constant over a wide range of operating current. A small increase in applied voltage greatly increases the current. Simple circuit 300 and alike are used for low-power indicator LEDs. A more complex driver circuit (e.g., the driver in FIG. 2) is used to drive high-power LEDs for illumination, which often employs PWM engines to regulate or modulate current.

Figure 4:
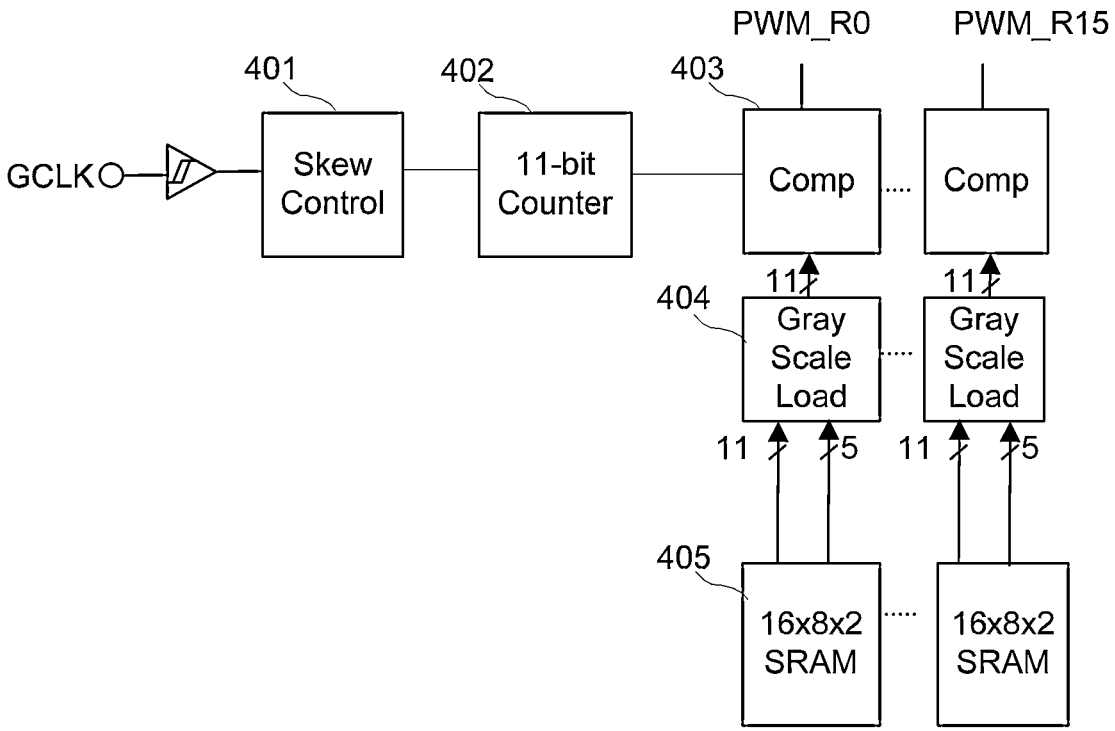
FIG. 4 is a diagram of an embodiment of a pulse width modulation (PWM) engine.

FIG. 4 is a block diagram of an embodiment of a PWM engine, which comprises a skew control 401, an 11-bit counter 402, sixteen sets of SRAMs 405, gray scale loading circuits 404, and adders and comparators 403.

The gray scale value for each LED is loaded through the serial I/O interface block 220. Each gray scale is a 16-bit value, corresponding to the 65536 levels of gray scale supported by the PWM circuit. To support 16×8 red LEDs, an SRAM of 16×8×16 is required. In FIG. 4, a 16×16×16 SRAM is used for the red LEDs. This ensures that while the current set of gray scales is being translated into the PWM circuit, the next set of gray scale values can be loaded at the same time. When the current set of gray scales are fully realized, the next scale is readily available for use.

Figure 5:
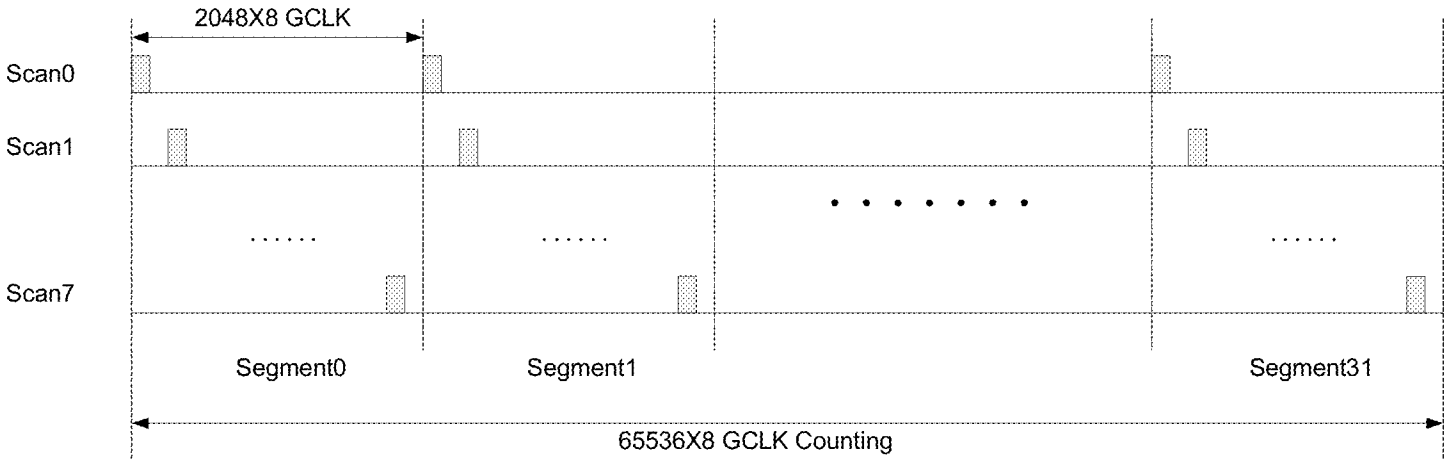
FIG. 5 is an exemplary timing diagram illustrating a sequence of PWM pulses.

The PWM engine is used to drive LEDs in thirty two refresh segments (i.e., segment 0 through segment 31) as illustrated in FIG. 5. During each refresh segment, each of the eight scan lines, scan0 through scan7, is driven once and the LEDs on each scan line is refreshed once. For each channel of a single scan line, the 16-bit gray scale value is split into two parts. Using the PWM engine designated for red LEDs (i.e., red LED PWM engine) as an example, the upper 11-bit value corresponds to the number of GCLKs that the red LED shall be on within a single refresh segment. The lower 5-bit value is realized through thirty two refresh segments. The gray scale loading circuit adjusts the 11-bit for each refresh segment based on the lower most 5-bit value of the 16-bit gray scale value. The final output of the gray scale loading circuit is an 11-bit value, which is then sent to a comparator. The comparator receives another input from an 11-bit counter. The 11-bit counter with the GCLK starts counting when the gray scale value is loaded.

The PWM_R0 becomes ON as long as the output from the 11-bit counter is less than the target clock counter limit. Once the counter output value equals to the target clock counter limit, PWM_R0 is shut off. This is done for all sixteen channels for red LEDs according to its target counter limit. The 11-bit counter will continue to increase until it overflows to zero. At that point or after a certain deadtime, it continues to generate PWM signals for the next scan line. The process of counting another 11-bit value is repeated for next seven scan lines. When all eight scan lines, scan0 through scan7, have gone through such a process of generating PWM signals, a single refresh segment is completed for the a group of 16×8 red LEDs. It is noted that all operations for green LED and blue LED PWM engines are functioning the same way as the red LED PWM engine does.

The PWM circuit also provides skew control across channels. By setting skew across different drive channels, it displaces the rising edge of drive current from channel to channel, effectively lower the EMI effect.

Figure 6:
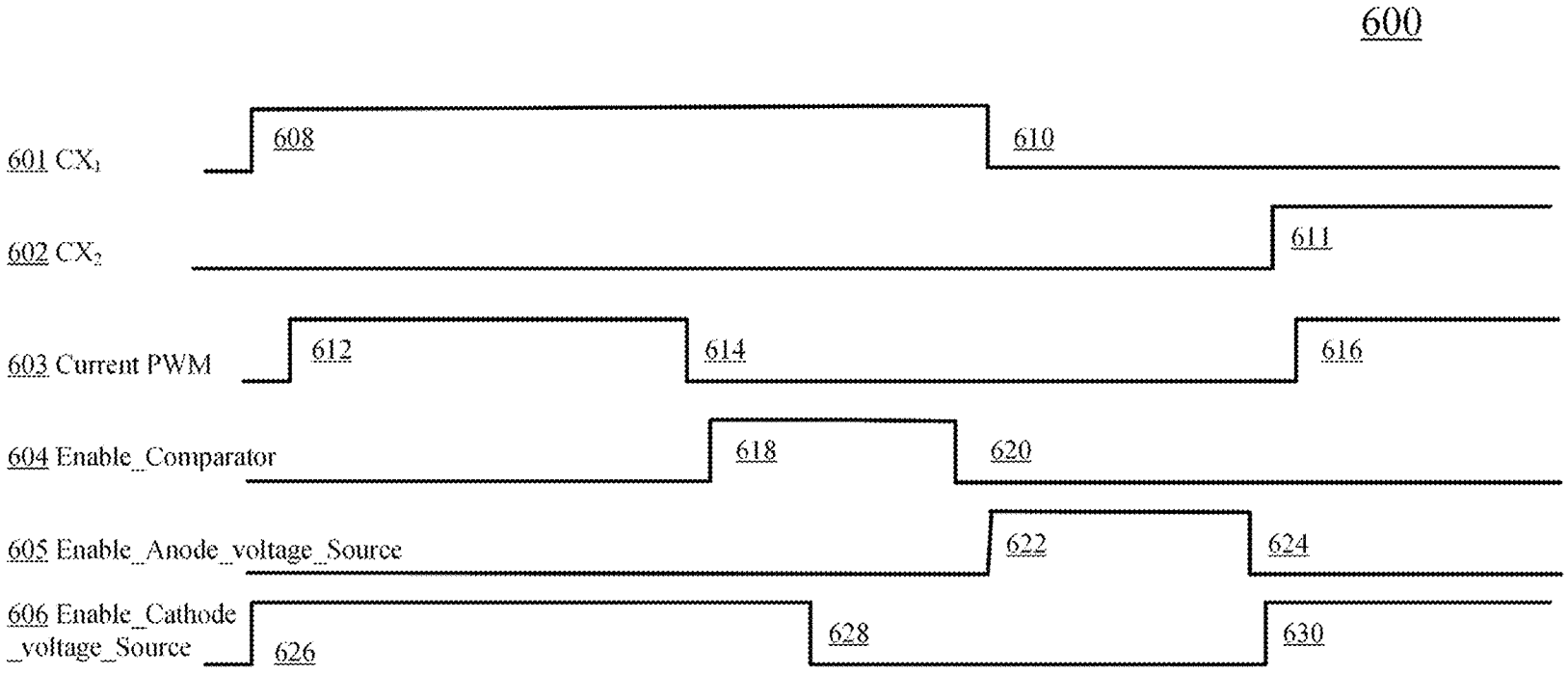
FIG. 6 is a diagram illustrating the timings of various control signals used in an exemplary voltage swing reduction circuit for an LED array in the current disclosure.
Figure 7:
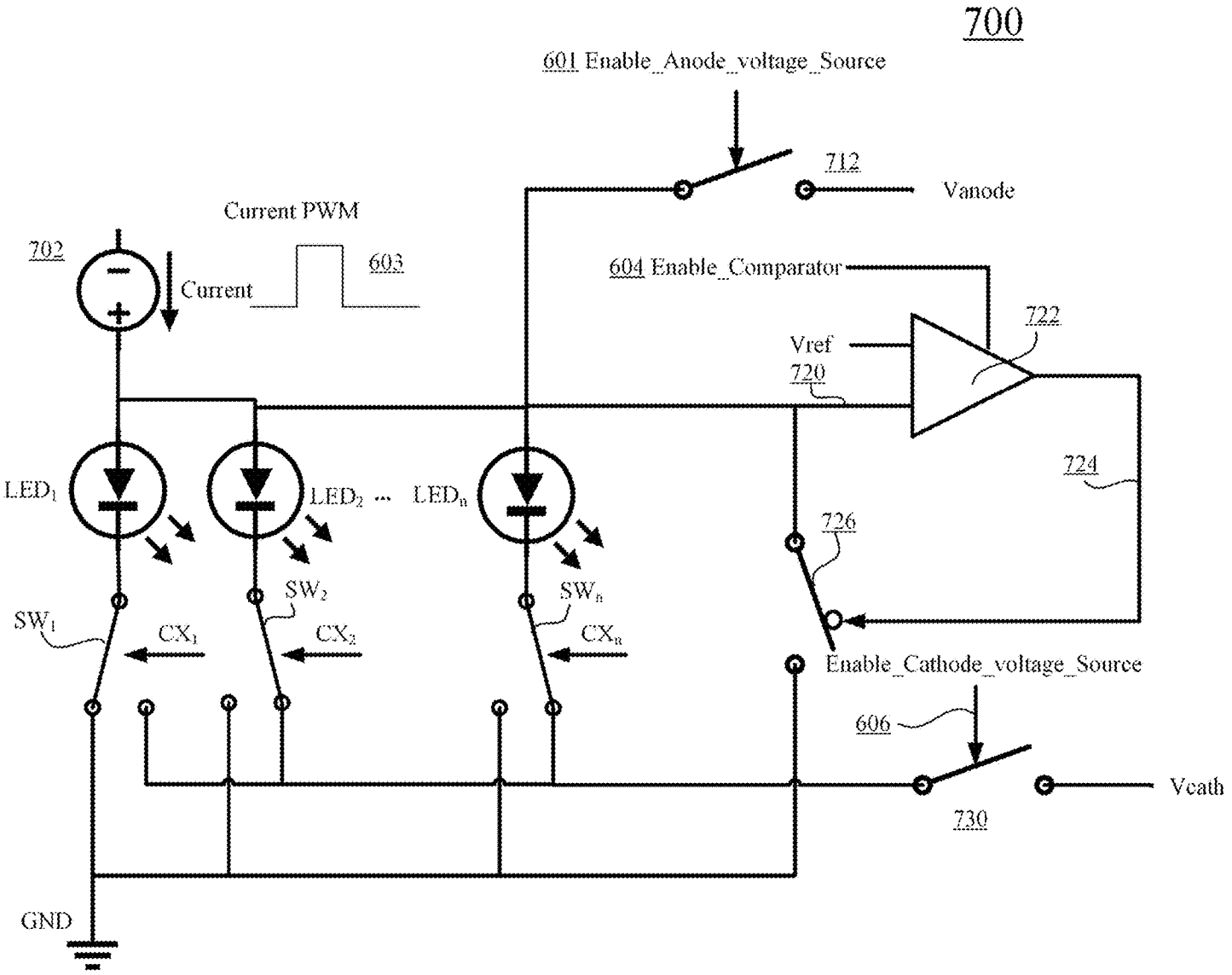
FIG. 7 is a diagram schematically illustrating one embodiment of the voltage swing reduction circuit for an LED array in the current disclosure.

FIGS. 6 and 7 schematically illustrate exemplary circuits of the current disclosure and the timing of various control signals. In particular, FIG. 6 shows timings of scan control signals—$CX_1$ 601 and $CX_2$ 602, the PWM signal—Current PWM 603, the comparator control signal—Enable_Comparator 604, the anode voltage control signal—Enable_Anode_Voltage_Source 605, and the cathode voltage control—Enable_Cathode_Voltage_Source 606. The reference voltage $V_{ref}$ is a voltage used an input to a comparator in the voltage swing reduction circuit, which will be discussed in later figures. The time of $V_{ref}$ 602 is not particularly restricted so long as it is ON when the Enable_Comparator 604 is ON so that the comparator 722 may function.

FIG. 7 shows an exemplary circuit according to one of the embodiments in the current disclosure. It shows a current source 702 that is connected to the anodes of $LED_1$ to $LED_n$ through the common anode node 720. Each $LED_{1-n}$ has its cathode connected to a corresponding scan switch among $CX_{1-n}$, i.e., $CX_1$ to $CX_n$. Each $CX_{1-n}$ in term is switchably connected to ground (GND) via one of scan switches $SW_{1-n}$ or to a cathode voltage supply ($V_{cath}$) via one of $SW_{1-n}$ and switch 730. The anode node 720 is switchably connected to an anode voltage supply ($V_{anode}$) via switch 712 as well as to a first input to comparator 722. The comparator 722 also has a second input that is connected to the reference voltage supply—$V_{ref}$. The output from the comparator 722 is switchably connected to the anode node 720 or to ground via switch 726.

Referring to FIG. 6, signal $CX_1$ 601 and signal $CX_2$ 602 control the ON/OFF state of the scan switches $SW_1$ and $SW_2$, respectively. Signal $CX_1$ 601 turns $SW_1$ on at the rising edge 608 and turned it off at the falling edge 610. Signal $CX_2$ 602 turns $SW_2$ on at 611, spaced apart from 610. FIG. 6 only shows one complete pulse between 608 and 610 in the scan control signal of $SW_1$ and the rising edge of the subsequent pulse in 602. Nevertheless, as shown in FIG. 1C, there are a plurality of consecutive pulses that turn on a certain scan switch at a certain frequency. At any given time only one scan switch is turned on.

When $SW_1$ is connected to ground, the PWM pulse in the signal 603 is ON between the rising edge 608 and the falling edge 610 to supply a current PWM pulse to $LED_1$ so that $LED_1$ may be lit by the PWM pulse. Further, the Enable_Comparator signal 604 is ON between the falling edge of the PWM pulse 614 and the falling edge 610 of the $CX_1$ pulse. Accordingly, after the current PWM pulse ends, the current supply to $LED_1$ is turned off. The anode voltage of $LED_1$ may start to drop. When the anode voltage drops to or below a threshold level (e.g., the forward voltage of the LEDs) due to a leaking current through $LED_1$, $LED_1$ is turned off. However, without intervention, the anode voltage may drop very slowly so that $LED_1$ may stay lit after the PWM pulse ends. Conventionally, the anode of $LED_1$ may be connected to a current sink (e.g., ground) so the anode voltage quickly goes to zero. However, dropping the anode voltage of the LED pixel to zero or otherwise too low would require charging it up when the LED pixel needs to be lit again, causing voltage swings.

Referring to both FIGS. 6 and 7, to prevent the anode voltage from dropping too low, the Enable_Comparator signal 604 is turned on right after the falling edge of the PWM pulse 603 so that the comparator 722 compares the values of its two inputs—$V_{ref}$ 602 and the voltage on the common anode node 720. In one of the embodiments, $V_{ref}$ is set to a value lower than the voltage in 702 right after the PWM pulse ends, e.g., 0.1 V, 0.2 V, 0.3 V, 0.4 V, 0.5 V, 0.6 V, 0.7 V, 0.8 V lower. The voltage in 702 is substantially kept at $V_{ref}$. After that, before switching $SW_2$ ON by $CX_2$ 602 and the lighting $LED_2$ by the subsequent current PWM pulse at 616, the signal 605 pulses between 622 and 624 to connect the common anode node 720 with $V_{anode}$. As such, the anodes of $LED_1$ to $LED_n$, including $LED_2$, are charged up to the same anode voltage $V_{anode}$ and ready to be lit.

The Enable_Cathode_Voltage_Source signal 606 controls the switch 730 to connect the common cathode node to or disconnect it from a common sink (such as ground). The signal 606 is a global signal that determines whether or not the cathode voltage of remainder of $LED_{1-n}$ is pulled to a predefined cathode voltage when one of them has its cathode grounded. For example, during the $CX_1$ pulse between 608 and 610, $SW_1$ is ON so that the cathode of $LED_1$ is grounded. The cathodes of $LED_{2-n}$ can be either floating if switch 730 is open or connected to $V_{cath}$ when switch 730 is closed. According to FIG. 6, cathodes of $LED_2$-n are connected to $V_{cath}$ between 626 and 628, during which switch 730 is closed, or are floating between 628 and 630.

By pulling the cathodes of $LED_{2-n}$ to $V_{cath}$, the difference between $V_{anode}$ to $V_{cath}$ may be small enough to prevent any of $LED_{2-n}$ being lit inadvertently. The cathode voltage level supplied by the cathode voltage source ($V_{cath}$) is programmable to accommodate variations of forward voltages and current requirements among the LEDs in the array. $V_{cath}$ may be set after testing the LED array, e.g., at a value of 0.2-0.8 V or 0.2-0.5 V. The timing of 628 is not particularly limited as long as it proceeds the rising edge 611 of $CX_2$ 602 and that the floating period between 628 and 611 are sufficiently long so that the cathode voltage of $LED_2$ can be sufficiently lowered to allow the PWM current to flow through $LED_2$ and light $LED_2$.

In some embodiments, one or more of the anode voltage source $V_{anode}$, the reference voltage source $V_{ref}$, and the cathode voltage source—$V_{cath}$, can be a precision voltage source, and can be an on-chip source or an off-chip source. In one embodiment, an LDO voltage regulator can be used for one or more amongst $V_{anode}$, $V_{ref}$, and $V_{cath}$.

It is noted that the actual implementation of the charging circuit and the voltage swing reduction circuit can be flexible and is not limited to aforementioned components. The implementation can use simple voltage comparator, op-amp, logic circuit and low-dropout regulators, but the combination of these circuits can achieve desired result so long as the used components can reduce the size of the LED display to go to smaller pitch for consumer-oriented display.

Figure 8:
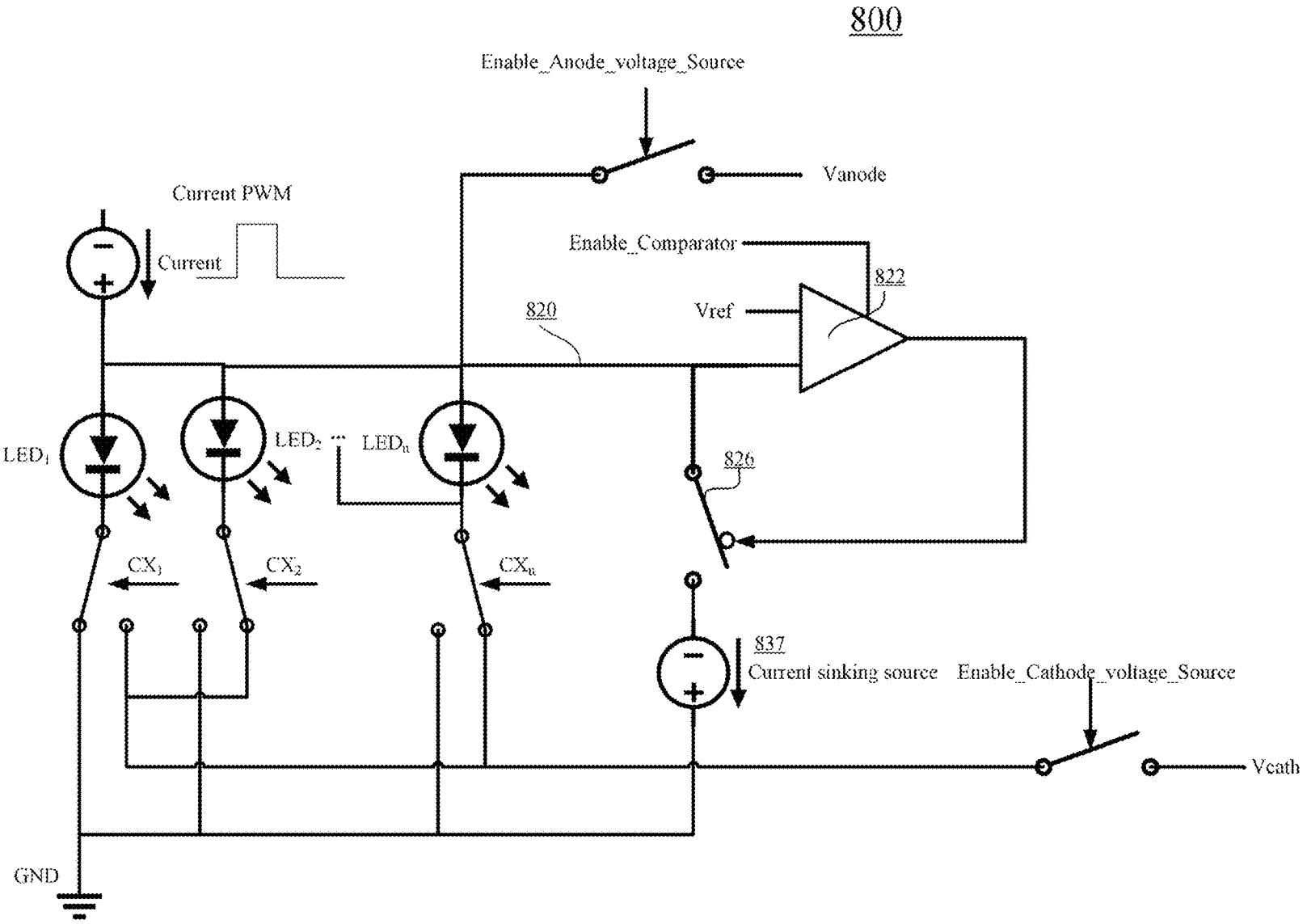
FIG. 8 is a diagram schematically illustrating another embodiment of the voltage swing reduction circuit for an LED array in the current disclosure.

Another embodiment of the current disclosure is shown in FIG. 8, which employs a Current Sinking Source 837. Components not labelled in FIG. 8 are identical to those shown in FIG. 7. When comparator 822 outputs a signal to turn on switch 836, the switch connects the common anode node 820 to Current Sinking Source 837 (which itself is connected to ground) as opposed to connecting the common anode node to ground directly in FIG. 7. The Current Sink Source 837 is a device that buffers the common anode node and regulates the current passing through it by using an upper limit for the passing current. Combined with switch 836, Current Sinking Source 833 helps the voltage at the common anode node change more smoothly, causing less turbulence and voltage bouncing in the driver circuit.

Figure 9:
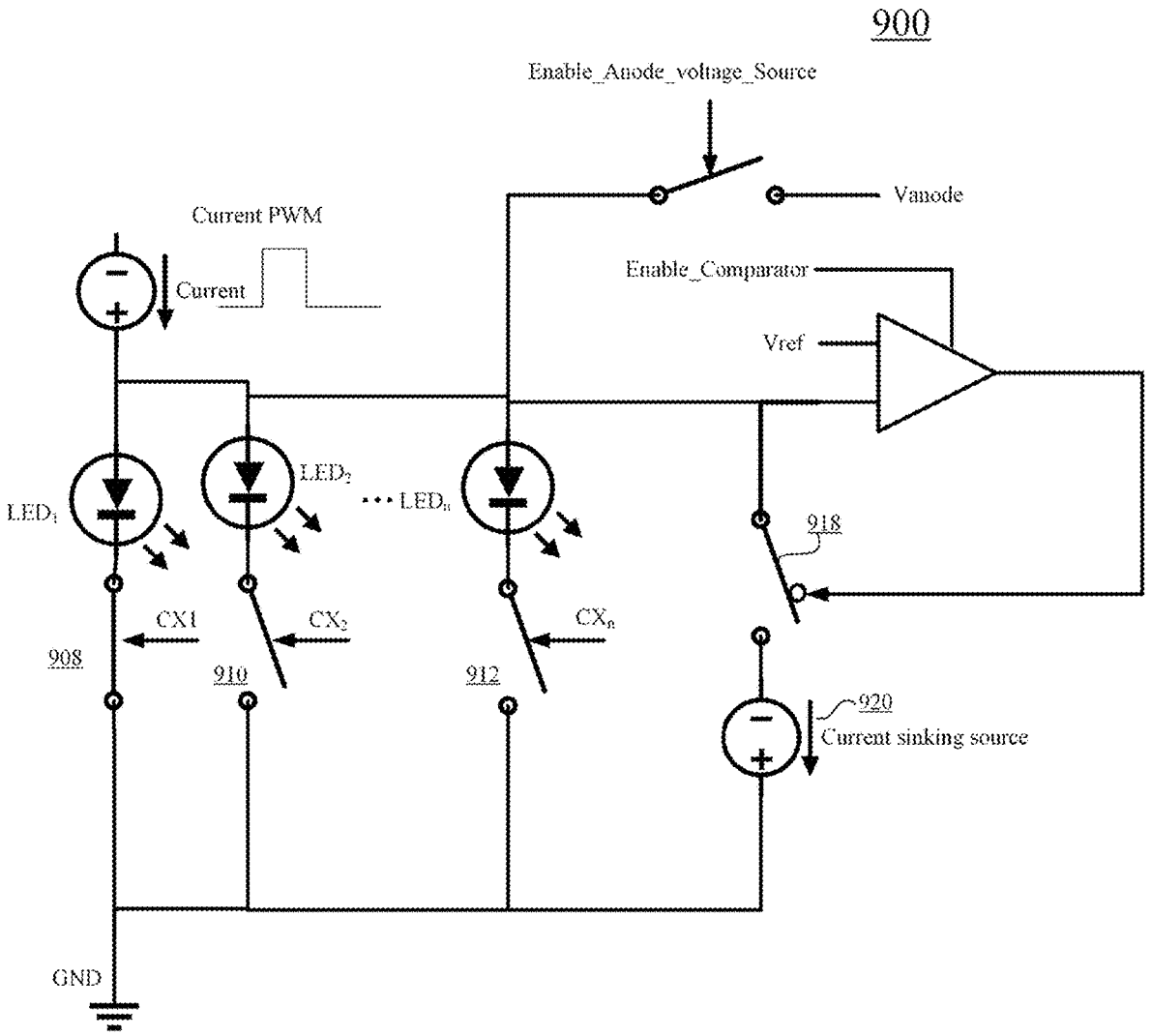
FIG. 9 is a diagram schematically illustrating a further embodiment of the voltage swing reduction circuit for an LED array in the current disclosure.

FIG. 9 schematically shows a further embodiment of the current disclosure, which has a simpler cathode voltage control structure than the embodiments depicted in FIGS. 7 and 8. Instead of switching between ground and $V_{cath}$ as in FIG. 7 or 8, cathodes of $LED_{1-n}$ in FIG. 9 are simply floating when the scan lines $LED_{1-n}$ connected to are not selected by $CX_n$. Without regulating the cathode voltages of $LED_{1-n}$, the circuitry can be smaller and less expensive, which is at the expense of less precise control of the timing of LED pixels and possibly requiring a higher anode voltage in order to light the LED pixels.

Similar to the embodiment in FIG. 8, the embodiment in FIG. 9 employs the Current Sinking Source 920. As discussed before, the Current Sink Source 920 buffers the common anode node and ground and regulates the current passing through it by using an upper limit for the passing current. Combined with switch 918, Current Sinking Source 920 facilitates a smooth drop of the voltage in the common anode node.

Figure 10A:
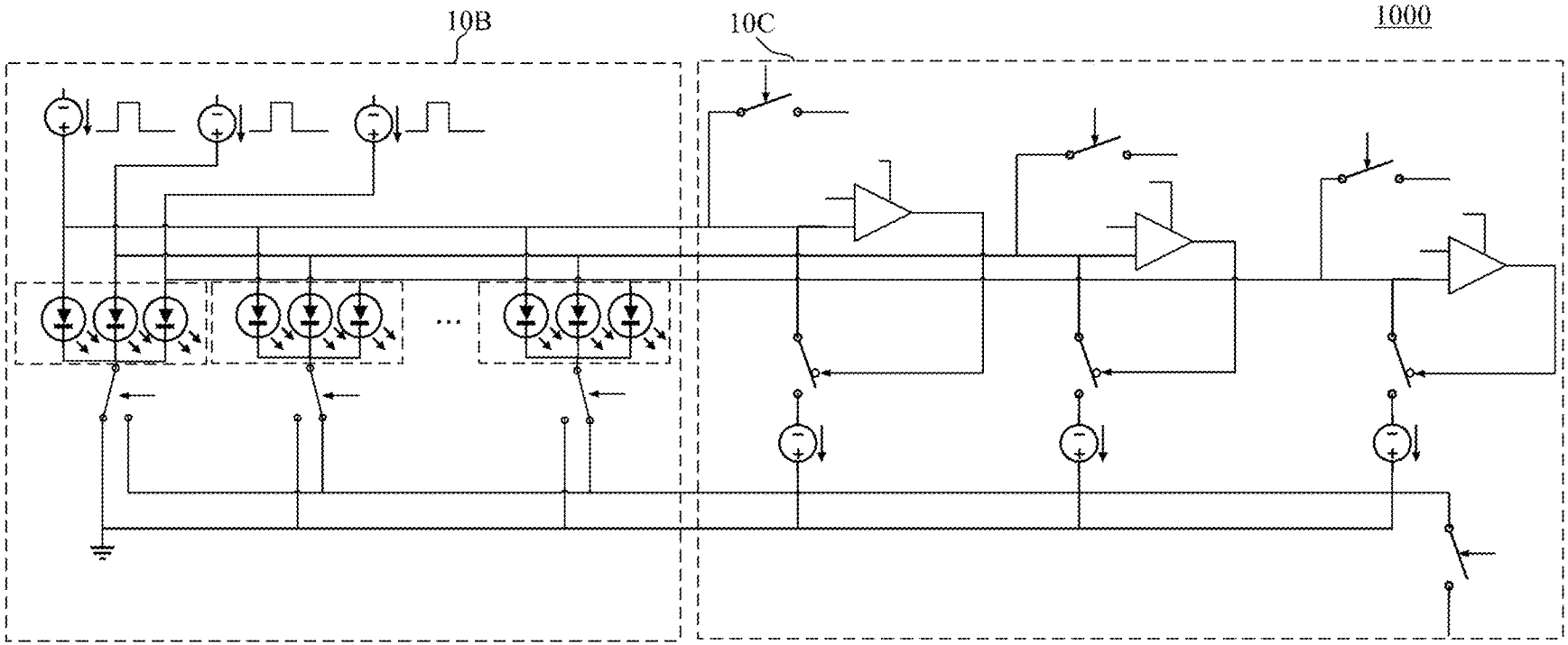
FIG. 10A is a schematic diagram showing an array of RGB LEDs and an exemplary voltage swing reduction circuit thereof.
Figure 10B:
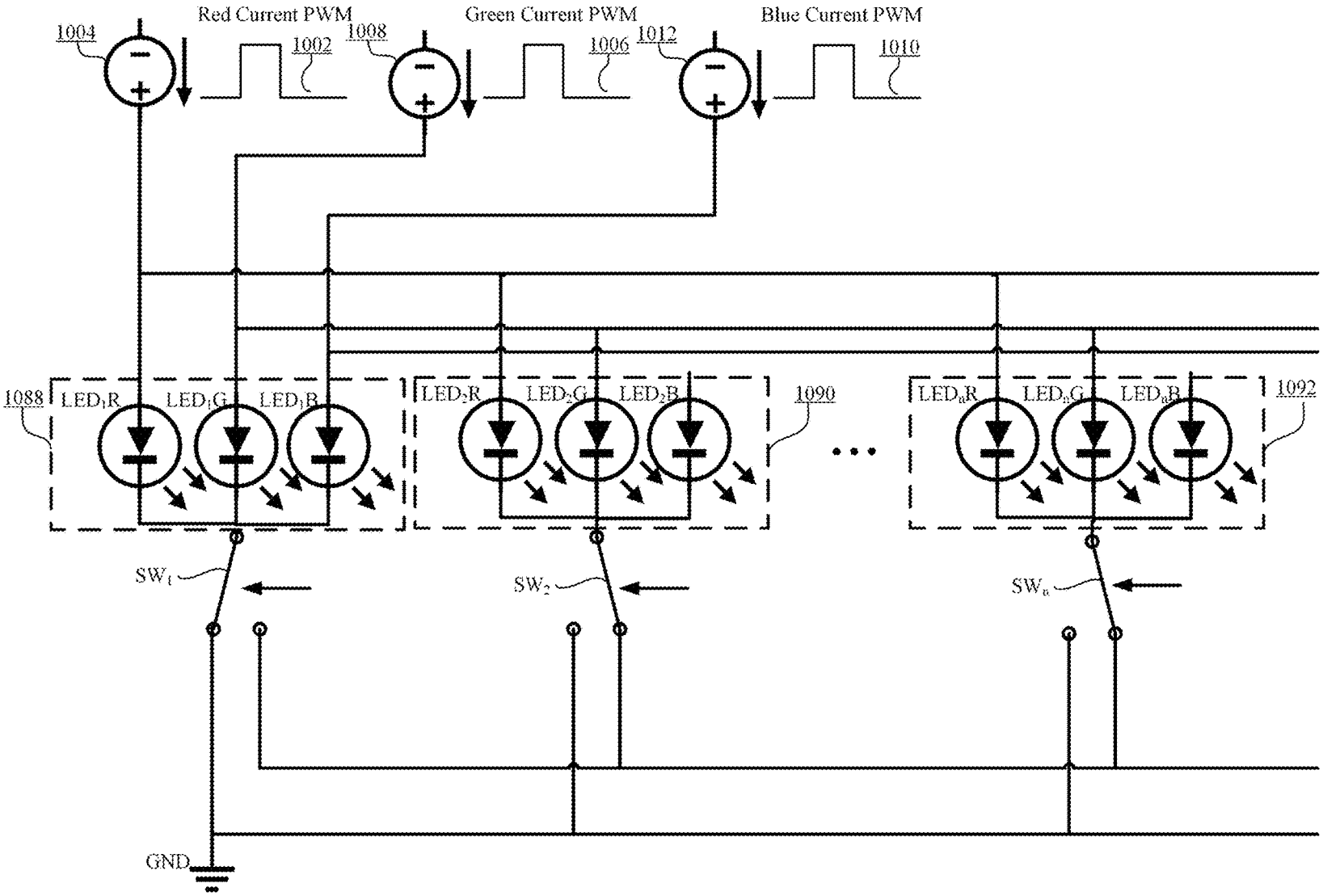
FIG. 10B shows details of one portion in FIG. 10A.
Figure 10C:
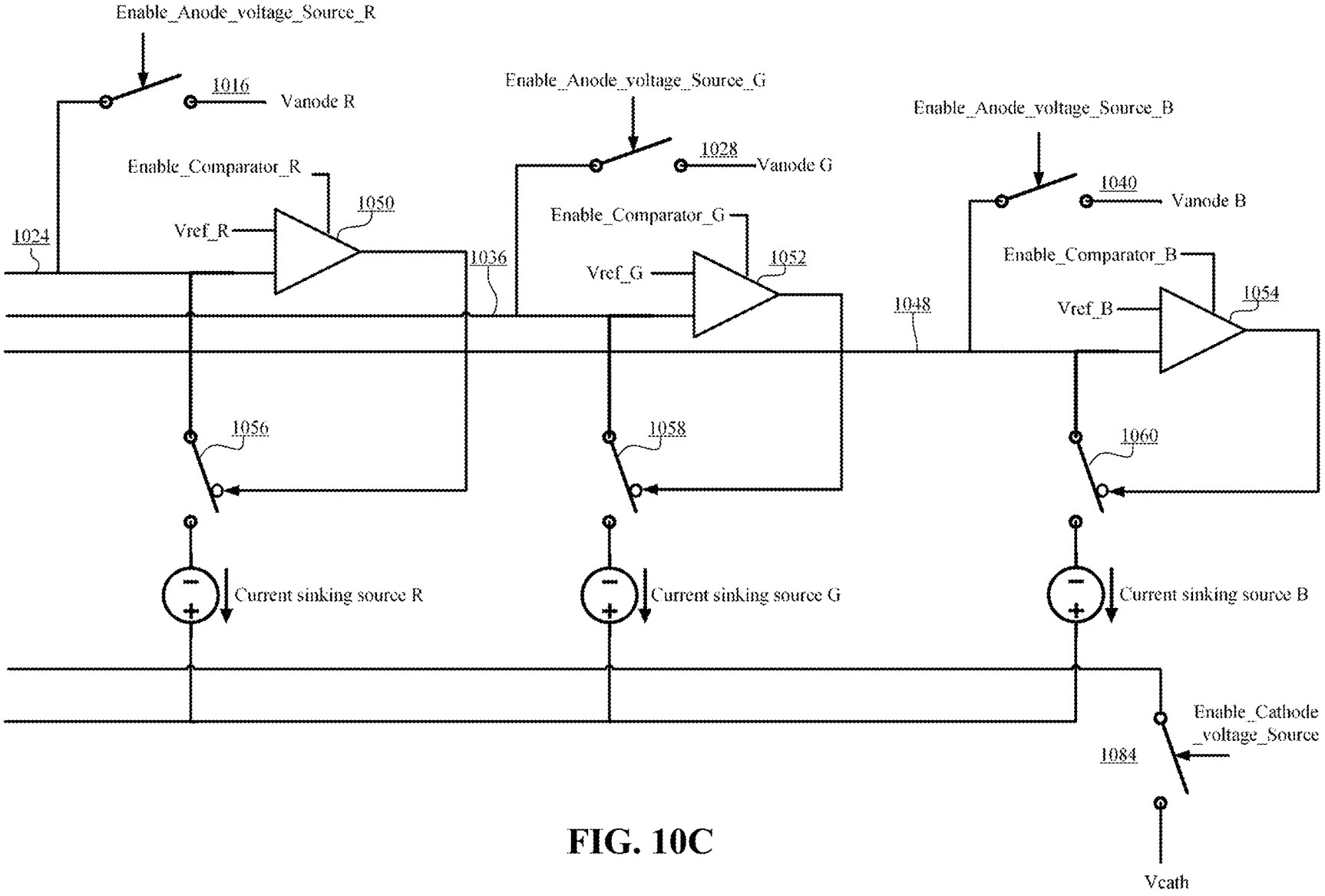
FIG. 10C shows details of another portion in FIG. 10B.

FIGS. 10A-10C schematically illustrate a voltage control circuit 1000 for a color LED panel with current sinking source. Each of the LED pixels in the panel is a RGB LED pixel that integrates a red LED, a blue LED, and a green LED. That is, each RGB LED pixel contains three R, G, B LEDs. Each of R, G, B, LEDs is connected to their respective current source (i.e., 1004, 1008, or 1012) but shares one common cathode pin connected to one of $SW_{1-n}$ via a corresponding scan line. The switch 1084, controlled by Enable_Cathode_Voltage_Source, opens or closes the connection between the common cathode node and the $V_{cath}$ source.

The circuits on the anode side of LED pixels in 1000, unlike the circuits on the anode of LED pixels in 700, are multiplied not only because the structure shown in 1000 controls multiple columns of RGB LED pixels (i.e., columns 1088, 1090, and 1092) but also because LEDs of different colors require different driver circuit and anode side voltage control circuit. The R, G, B, LEDs in column 1088, despite their different colors, are controlled by scan line signal $CX_1$, which controls SW to connect to (or disconnect from) ground 1080. Likewise, the R, G, B LEDs in column 1090, despite their different colors, are controlled by scan line signal $CX_2$ that turns on/off $SW_2$ to connect to (or disconnect from) ground 1080, while the R, G, B LEDs in column 1092, despite their different colors, are controlled by scan line signal $CX_n$ 1072 that turns on/off $SW_n$ to connect to (or disconnect from) ground 1080.

The R, G, B LEDs in column 1088 are connected to their respective current source independently. For example, the red LEDs in column 1088 are connected to current source 1004, which is controlled by Red Current PWM signal 1002; the green LED in column 1088 is connected to current source 1008, which is controlled by Green Current PWM signal 1006; and the blue LED in column 1088 is connected to current source 1012, which is controlled by Green Current PWM signal 1010. The timings of signals 1002, 1006 and 1010 are controlled by PWM data based on the image data. The control of each R, G, or B LEDs is similar to that described in association with FIGS. 6 and 7.

Similar to R, G, B LEDs in column 1088, R, G, B, LEDs in column 1090 are connected to their respective current source. Specifically, the red LED in column 1090 is connected to current source 1004, which is controlled by Red Current PWM signal 1002, the green LED in column 1090 is connected to current source 1008, which is controlled by Green Current PWM signal 1006, and the blue LED in column 1090 is connected to current source 1012, which is controlled by Green Current PWM signal 1010. The timings of signals 1002, 1006 and 1010 are synchronized if not identical, as they have to be ON with the ON period of scan line signal $CX_2$ 1070, and OFF before $CX_2$ is OFF, just like Current PWM signal 704 has to be ON within the ON period of scan line signal $CX_1$ 703, and OFF before $CX_1$ 703 is OFF in diagram 740.

Scan line signal $CX_2$ 1070 turns switch 1076 to connect to ground 1080 upon an ON pulse, and upon an OFF pulse, turns the switch to connect to switch 1084 which, under the control of Enable Cathode Voltage Source, connects to the $V_{cath}$ source.

In many embodiments of the disclosure, just like having an independent and separate control circuit for LEDs with the same color, there is an independent and separate anode voltage control circuit for LEDs with the same color. For example, LED1R in column 1088, LED2R in column 1090, and LEDnR in column 1092, collectively as group RED, has an Anode_Voltage_Control_Circuit_R (abbreviated as AVCCR) composed of Enable_Cathode_Voltage_Source_R signal 1014, switch 1016, $V_{anode}$ R 1018, Enable_Comparator_R signal 1020, $V_{ref}$ R 1022, common anode node R 1024, Comparator R 1050, switch 1056, and Current Sinking Source R 1062.

LED1G in column 1088, LED2G in column 1090, and LEDnG in column 1092, collectively as group GREEN, has an Anode_Voltage_Control_Circuit_G (abbreviated as AVCCG) composed of Enable_Cathode_Voltage_Source_G signal 1026, switch 1028, $V_{anode}$ G source 1030, Enable_Comparator_G signal 1032, $V_{ref}$ G 1034, common anode node G 1036, Comparator G 1052, switch 1058, and Current Sinking Source G 1064.

LED1B in column 1088, LED2B in column 1090, and LEDnB in column 1092, collectively as group BLUE, has an Anode_Voltage_Control_Circuit B (abbreviated as AVCCB) composed of Enable_Cathode_Voltage_Source_B signal 1038, switch 1040, $V_{anode}$ B source 1042, Enable_Comparator B signal 1044, $V_{ref}$ B 1046, common anode node B 1048, Comparator B 1054, switch 1060, and Current Sinking Source B 1066.

AVCCR, AVCCG, and AVCCB each may work in the same way as described for the voltage control circuit in FIG. 7 or 8, and the timings of signals in each circuit are managed according to the same sequence of FIG. 6.

Figure 11:
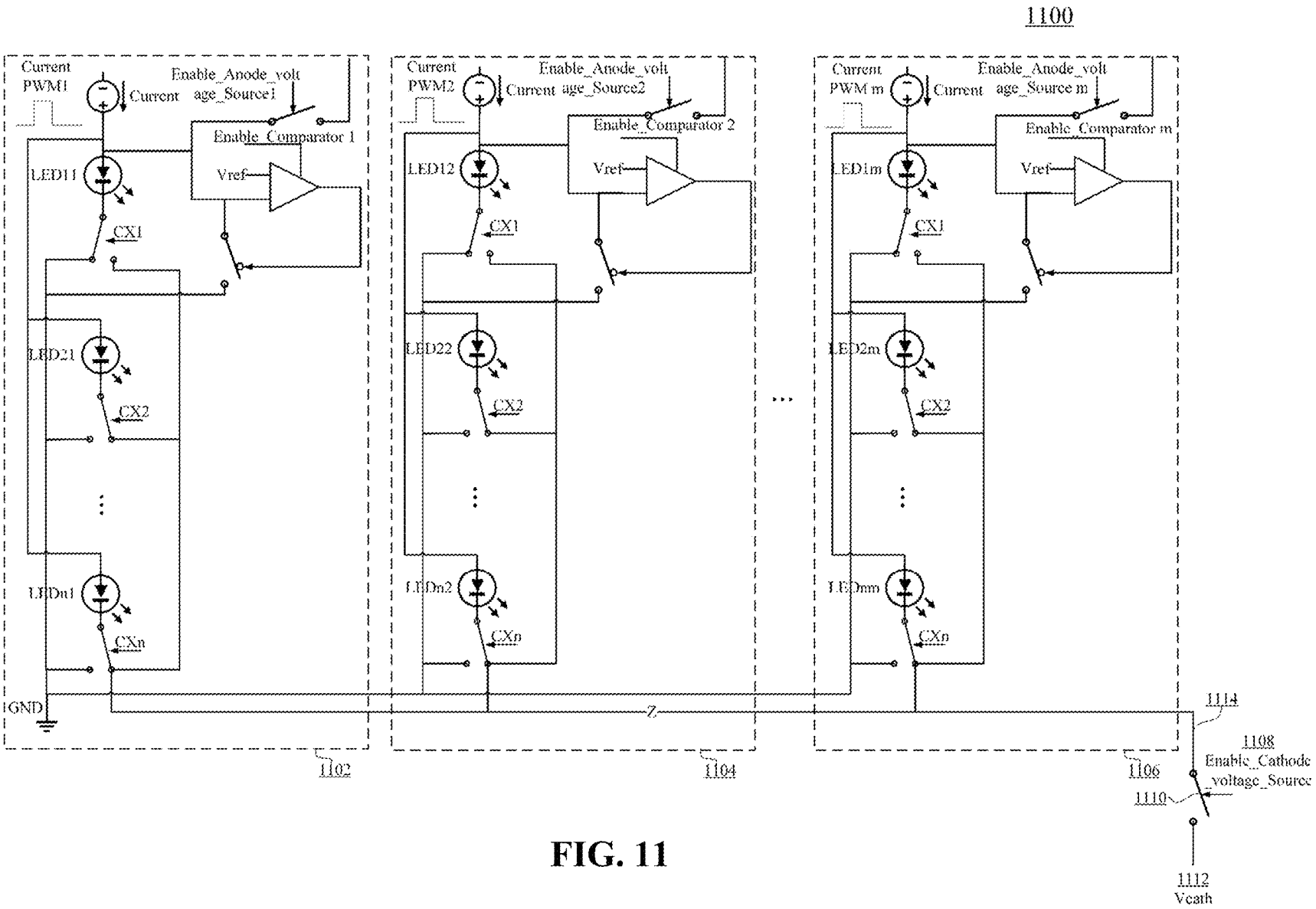
FIG. 11 is a diagram schematically illustrating a voltage control circuit for a single-color common cathode LED panel.

FIG. 11 schematically illustrates a voltage control circuit 1100 for a single-color common cathode LED panel with no current sinking source. The circuit can be conceptually compartmented into three columns: 1102, 1104, and 1106. The three columns share a common voltage control circuit composed of the cathode node 1114, Enable_Cathode_Voltage_Source 1108, switch 1110, and $V_{cath}$ 1112. Within each of the three columns 1102, 1104, and 1106, the layout and working mechanism of LEDs and their corresponding driver circuit and anode voltage control circuit may have the same layout and working mechanism of LEDs and their corresponding driver circuit and anode voltage control circuit described in conjunction with diagrams 700 and 740. Therefore, while FIG. 7 is a zoom-in view of a column of LEDs in an LED panel (array), FIG. 11 is a zoom-out view of all LEDs in an LED panel (array).

Many modifications and other embodiments of the disclosure will come to the mind of one skilled in the art having the benefit of the teaching presented in the forgoing descriptions and the associated drawings. For example, the control IC can be used to drive an LED array in either common cathode or common anode configuration. Elements in the LED array can be single color LEDs or RGB units or any other forms of LEDs available. The control IC can be scaled up or scaled down to drive LED arrays of various sizes. Multiple control ICs may be employed to drive a plurality of LED arrays in a LED display system. The components in the control circuit, in the charging circuit, and in the voltage swing reduction circuit, can either be integrated on a single chip or on more than one chip or on the PCB board. Such variations are within the scope of this disclosure. It is to be understood that the disclosure is not to be limited to the specific embodiments disclosed, and that the modifications and embodiments are intended to be included within the scope of the dependent claims.

Although the foregoing embodiments have been described in some detail for purposes of clarity of understanding, the disclosure is not limited to the details provided. There are many alternative ways of implementing the disclosure. The disclosed embodiments are illustrative and not restrictive.

It is conceivable that more and more LEDs will be driven by one driver to save the cost and physical space, and as the result, accumulatively, there will be more and higher capacitance loading and unloading needed in both anode and cathode of the LEDs to drive the increasingly numerous LEDs. The high voltage swing in the driver circuit of a LED panel cramped with a large number of LEDs brings at least two problems: increasing the needless power consumption, and increasing the vulnerability to forward voltage variation across LEDs in an LED panel which makes the panel unstable. Therefore, the embodiments of the disclosure help reducing voltage swing in the driver circuit of an LED system, reducing noise therein and saving power in its transient operations, and making it a green display product. The benefits of the disclosure would be obvious to one skilled in the art, and the benefits come at tolerable cost.

What is claimed is:

1. A light emission diode (LED) display panel, comprising:

an LED array having a plurality of LED pixels, a plurality of scan switches, and a plurality of LED columns, wherein each LED pixel is connected to one of the plurality of LED columns, wherein an anode of each LED pixel in each LED column is connected to a common anode node and the common anode node is connected to an output of a current source, wherein a cathode of each LED pixel in each LED column is switchably connected to a current sink via one of the plurality of scan switches, wherein the common anode node is connected to a first input of a comparator circuit and is switchably connected to an anode voltage source, wherein a second input of the comparator circuit is connected to a reference voltage source, and an output of the comparator circuit signally controls a switch member that connects the common anode node to the current sink or disconnects the common anode node from the current sink.

2. The LED display panel of claim 1, wherein the cathode of each LED pixel in each LED column is switchably connected to a common cathode node, and the common cathode node is switchably connected to a cathode voltage source.

3. The LED display panel of claim 2, wherein one or more of the cathode voltage source, the reference voltage source, and the anode voltage source is a configurable low-dropout regulator (LDO).

4. The LED display panel of claim 1, wherein all LED pixels in each LED column are red LED pixels, green LED pixels, or blue LED pixels.

5. The LED display panel of claim 4, wherein the common anode node is switchably connected to ground via a current sinking source.

6. The LED display panel of claim 1, wherein each LED pixel in each LED column is an RGB LED pixel having a red LED, a green LED, and a blue LED that share a common cathode.

7. The LED display panel of claim 6, wherein, in each RGB LED pixel, an anode of the red LED is connected to a first current source, an anode of the green LED is connected to a second current source, and an anode of blue LED is connected to a third current source.

8. The LED display panel of claim 6, wherein, in each RGB LED pixel, an anode of the red LED is connected to one current source, an anode of the green LED and an anode of blue LED are connected to another current source.

9. The LED display panel of claim 6, wherein the current sink is ground.

10. The LED display panel of claim 1, wherein the one or more current sources are connected with and controlled by a PWM generator.

11. A method for operating the LED array of claim 1, comprising:

charging the anodes of the plurality of LEDs to an anode voltage of the anode voltage source by connecting the anodes of the plurality of LEDs to the anode voltage source via the common anode node;

connecting a cathode of a first LED in the plurality of LEDs to the current sink by closing a first scan switch;

turning on the first LED by passing a first driving current through the first LED;

setting a reference voltage of the reference voltage source at a value lower than the anode voltage; and pulling down a voltage of the common anode node to the reference voltage, wherein the comparator causes the common anode node to be connected to the current sink when the voltage in the common anode node is higher than the reference voltage.

12. The method of claim 11, further comprising:

pulling up the voltage of the common anode node to the anode voltage by connecting the common anode node to the anode voltage source; and connecting a cathode of a second LED in the plurality of LEDs to the current sink by closing a second scan switch; and turning on the second LED by passing a second driving current through the second LED.

13. The method of claim 11, wherein the reference voltage is 0.1-0.8 V lower than the anode voltage of the anode voltage source.

14. The method of claim 11, further comprising:

disabling the comparator; and connecting the common anode node to an anode voltage source so that the voltage of the common anode node is about a voltage of the anode voltage source.

15. The method of claim 14, wherein the reference voltage is set at 0.2-0.4 V lower than the voltage of the anode voltage source.

16. The method of claim 11, wherein, when the voltage of the common anode node is higher than the reference voltage, the comparator causes the common anode node to be connected to the current sink.

17. The method of claim 11, further comprising connecting the cathodes of the remainder of the plurality of LED pixels to a cathode voltage source.

18. The method of claim 11, where the reference voltage is adjustable and is set at 0.1-0.8 V lower than the voltage of the anode voltage source.

19. The method of claim 11, wherein the cathode voltage is adjustable and is set at 0.2-0.5 V.

20. A method for reducing voltage swing of a plurality of LED pixels in an LED array, comprising:

connecting anodes of each LED pixel to a common anode node;

connecting the common anode node to an output of a current source and a first input of a comparator;

connecting a reference voltage source to a second input of a comparator;

sequentially lighting the plurality of LED pixels by sequentially connecting a cathode of one of the plurality of LED pixels being lit to a current sink and disconnecting cathodes of a remainder of the plurality of LED pixels from the current sink; and enabling the comparator to compare a reference voltage of the reference voltage source with a voltage of the common anode node after one LED pixel among the plurality of LED pixels is turned off and before another LED pixel among the plurality of LED pixels is turned on so that the voltage of the common anode node is maintained at about the reference voltage.

* * * * *